US007339549B2

(12) United States Patent
Maxwell

(10) Patent No.: US 7,339,549 B2
(45) Date of Patent: Mar. 4, 2008

(54) UNIVERSAL MOUNTING ASSEMBLY

(75) Inventor: James William Maxwell, Atlanta, GA (US)

(73) Assignee: Andrew Corporation, Norcross, GA (US)

( * ) Notice: Subject to any disclaimer, the term of this patent is extended or adjusted under 35 U.S.C. 154(b) by 0 days.

(21) Appl. No.: 11/457,372

(22) Filed: Jul. 13, 2006

(65) Prior Publication Data

US 2008/0012785 A1 Jan. 17, 2008

(51) Int. Cl.
*H01Q 1/12* (2006.01)

(52) U.S. Cl. ..... 343/892; 343/878; 343/890; 248/218.4

(58) Field of Classification Search ..... 343/881, 343/882, 890, 891, 892, 878; 248/218.4, 248/230.4
See application file for complete search history.

(56) References Cited

U.S. PATENT DOCUMENTS 4,799,064 A * 1/1989 Nakamura ..... 343/766
5,526,010 A * 6/1996 Plunk ..... 343/882
5,867,132 A * 2/1999 Blasing et al. ..... 343/890
5,963,179 A * 10/1999 Chavez ..... 343/892
6,045,103 A * 4/2000 Costa et al. ..... 248/278.1
6,232,928 B1 5/2001 Zimmerman et al.
6,262,691 B1 7/2001 Austin et al.
6,456,258 B1 * 9/2002 Bragg et al. ..... 343/892
6,563,475 B2 5/2003 Ianello et al.
6,664,937 B2 12/2003 Vermette et al.
7,106,273 B1 * 9/2006 Brunson et al. ..... 343/890
7,113,145 B1 * 9/2006 Noble ..... 343/892
2002/0053996 A1 5/2002 Ianello et al.
2002/0089466 A1 7/2002 Magee et al.
2002/0196195 A1 12/2002 Vermette et al.
2003/0189527 A1 10/2003 Goncalves et al.

* cited by examiner

*Primary Examiner*—Tho Phan
(74) *Attorney, Agent, or Firm*—Troutman Sanders LLP; James Hunt Yancey, Jr.; Flip A. Kowalewski

(57) ABSTRACT

A universal mounting assembly that can be attached to both a cylindrical surface and a planar surface is provided according to embodiments of the present invention. The universal mounting assembly includes a top plate, a bottom plate, and a spacer. Both the top plate and the bottom plate have a pair of parallel edge portions and at least one curved edge portion that is disposed between the two parallel edge portions. The curved edge portion on the top and bottom plate contains at least one mounting tab for attaching the universal mounting assembly to a cylindrical support structure. The universal mounting assembly also includes planar mounting brackets located at each intersection of the parallel edge portions and the curved edge portion for mounting to a planar support structure. The top plate and the bottom plate are rigidly affixed to the spacer, which may be annular shaped and used to house electronic components, such as a lightning protection circuit. Other embodiments are also claimed and described.

20 Claims, 7 Drawing Sheets

UNIVERSAL MOUNTING ASSEMBLY

TECHNICAL FIELD

The various embodiments of the present invention are directed to a universal mounting assembly, and more particularly to a universal mounting assembly that may be used to couple together cylindrical surfaces, planar surfaces, or combinations thereof. Furthermore, the present invention's embodiments are also directed to a universal mounting bracket to attaching a lightning protection circuit or any other electrical component to either a cylindrical or planar surface.

BACKGROUND

Cellular ("wireless") communications networks rely on a network of antennas for connecting cellular devices, such as cellular telephones, to the wireless network. To insure that the cellular communications network has continuous coverage over a geographic area, the antennas structures are widely dispersed throughout the region. Some antennas structures must be mounted to a mast, tower, or pole that is free standing, while other antennas structures may be mounted to a mast that is attached to a side of building or similar structure. In addition, it is sometimes necessary to increase the height of the antenna due to the construction of new structures, or to add additional antennas to an existing structure. Currently, cellular antenna tower can be connected to support structures, such as masts or buildings using conventional mounting brackets that are well known in the art.

Additionally, it may also be necessary to use mounting brackets to mount electrical components to existing antennas structures. A antenna tower today may have antennas, tower mounted low noise amplifiers (TMAs), tower mounted power amplifiers, repeaters, backhaul systems, point-to-point communication systems, and/or antenna control electronics mounted along or near the top of the structure, for example In addition, it may be desirable to provide lightning protection to a cellular antenna or other tower mounted electronics system, as in many instances it will be the tallest structure in the immediate area and susceptible to nearby or direct lightning strikes. The effectiveness of the lightning protection circuit may warrant mounting close to the cellular antenna and also mounting the device on or near the base of the antenna to protect the antenna electronics circuitry. In addition, it may be more effective protection and economical for protection designs involving layers of lightning protection circuitry by having a local externally mounted protection circuit serving multiple antennas and supplementing the individual internal antenna electrical components. The protection circuitry in the unit design may be deemed marginal or insufficient for the degree of reliability desired for sites with difficult access and supplemental lighting protection in an external module may be desired. In each of these situations, the electrical component is placed in a housing and/or attached to the antenna or the antenna support structure using a conventional mounting bracket.

Conventional mounting brackets have several limitations. Since the cellular antennas can be attached to either a cylindrical mast or a planar surface the mounting brackets have been tailored to match the type of structure. For instance, if an antenna is being mounted to a cylindrical surface, such as a mast or a pole, the antenna would include a specially designed mounting bracket that has a curved surface, which mates the antenna to a cylindrical structure.

Similarly, if the antenna must be mounted on a planar surface, such as a side of a building or other similar structure, a separate mounting bracket that is specially designed for use with planar surfaces must be used to attach the antenna to the planar structure. This requires cellular providers to purchase and store a variety of mounting brackets. Since cellular providers maintain hundreds of cellular support structures, the cost of purchasing several different brackets is very expensive in both time and capital expenditure, as cellular providers must constantly monitor their inventories of the different brackets to insure they do not run out of, or have an excess surplus of, any particular type of bracket.

Therefore, there is a continuing need for an inexpensive, universal mounting assembly that can be used for installation on a variety of mounting structures, such as a curved structure or a planar structure. In particular, there is a need for a universal mounting assembly that contains a first mounting bracket that can be adapted to be attached to a cylindrical surface and also contains a second mounting bracket that allows the universal mounting assembly to be attached to a planar surface.

SUMMARY

Embodiments of the present invention meet the needs described above in a universal mounting assembly, which may be attached to a cylindrical surface, a planar surface, or a combination thereof. Generally described, the universal mounting assembly includes a top plate, a bottom plate, and a spacer. Both the top plate and the bottom plate have a pair of parallel edge portions that are substantially parallel to one another and at least one curved edge portion that is disposed between the two edge portions. The mounting assembly also contains at least one mounting tab disposed along the curved edge portion for mounting the universal mounting assembly to a cylindrical support structure. The mounting assembly also includes planar mounting brackets located at each intersection of the parallel edge portions with the curved edge portion for attaching the universal mounting assembly to a planar support structure. The spacer is disposed between the top plate and the bottom plate and is used to secure the top plate and bottom plate in a fixed position relative to one another. The spacer may also serve to provide a cavity to house electronic circuitry or other devices suitable for the application.

More particularly described, the curved edge portion is concave in shape so as to engage the cylindrical support structure. The mounting tab from the top plate is located proximate to the mounting tab of the bottom plate and form a channel with the spacer for receiving a band clamp fastener for securing the universal mounting assembly to the cylindrical surface. The spacer, which is disposed between the top plate and the bottom plate may be made from a solid structure. Alternatively, the spacer may have an annular shape, in which the central portion is hollow. The spacer may also include several internal baffles or support structures to provide additional stability and strength to the universal mounting bracket under heavier load conditions.

Embodiments of the present invention are also directed to a universal mounting assembly for attaching an electronic component to a support structure. The universal mounting assembly includes a top plate and a bottom plate, which both include a pair of parallel edge portions, a curved edge portion, and a straight edge portion disposed between the two parallel edge portions. The curved edge portion contains at least one mounting tab for attaching the universal mounting assembly to a cylindrical support structure. The universal mounting assembly also includes planar mounting brackets that are used to attach the universal mounting assembly to a planar support structure. The planar mounting brackets may be located at the intersection of the parallel edge portions the concave curved portion. The assembly also includes an annular-shaped spacer positioned between the top plate and the bottom plate and encloses the electronic component. In order to protect the electronic component from environmental conditions, the universal mounting assembly may also include gaskets disposed between both the top plate and the bottom plate and the annular-shaped spacer to provide a watertight seal. The universal mounting assembly may also include a fastener, such as a band clamp or U-bolt for engaging the mounting tab of the top plate and the bottom plate and securing the universal mounting assembly to a cylindrical support structure.

Some embodiments of the present invention also includes a cellular antenna system, which includes a lightning protection circuit. The cellular antenna system includes a cellular antenna, a support structure and a universal mounting assembly for housing the lightning protection circuit. The universal mounting assembly includes a top plate, a bottom plate, and an annular-shaped spacer disposed between the top plate and the bottom plate. Both the top plate and the bottom plate include a pair of edge portions that are oriented parallel to one another, a concaved curved edge portion located between the pair of parallel edge portions, and a linear edge portion, which is also located between the parallel edge portions. The curved edge portion includes at least one mounting tab for attaching the universal mounting assembly to a cylindrical support structure. In addition, the universal mounting assembly includes planar mounting brackets located at the intersection of the parallel edge portions and the curved edge portions to allow the universal assembly to be mounted to a planar support surface. The lightning protector is housed within the universal mounting assembly and is connected in series typically via a shielded multi-conductor cable between the antenna and the electronics equipment remotely located from the antenna. To insure that the lightning protection circuit is protected from environmental conditions such as rain, wind, and dirt, a gasket may be placed between both the top plate and the bottom plate and the annular-shaped spacer to protect the lightning protection circuit from environmental conditions.

The various aspects and embodiments of the present invention may be more clearly understood and appreciated from a review of the following detailed description of the disclosed embodiments and by reference to the appended drawings and claims.

DETAILED DESCRIPTION

Embodiments of the present invention are directed to a universal mounting assembly, which may be mounted to either a curved surface or a planar surface. The universal mounting assembly includes top plate and a bottom plate, which may be attached to a spacer disposed between the two plates to form the universal mounting assembly. Both the top and the bottom plate include two pairs of mounting tabs. The first pair of mounting tabs is located along the curved edge portion of each plate and is used to mount the assembly to a curved structure. The second sets of mounting tabs on each plate are oriented so that they may be used to attach the universal mounting assembly to a planar structure. In addition, the universal mounting assembly may be configured so that the spacer can house an electrical component that may be attached to an antenna mast or an antenna structure.

Figure 1:
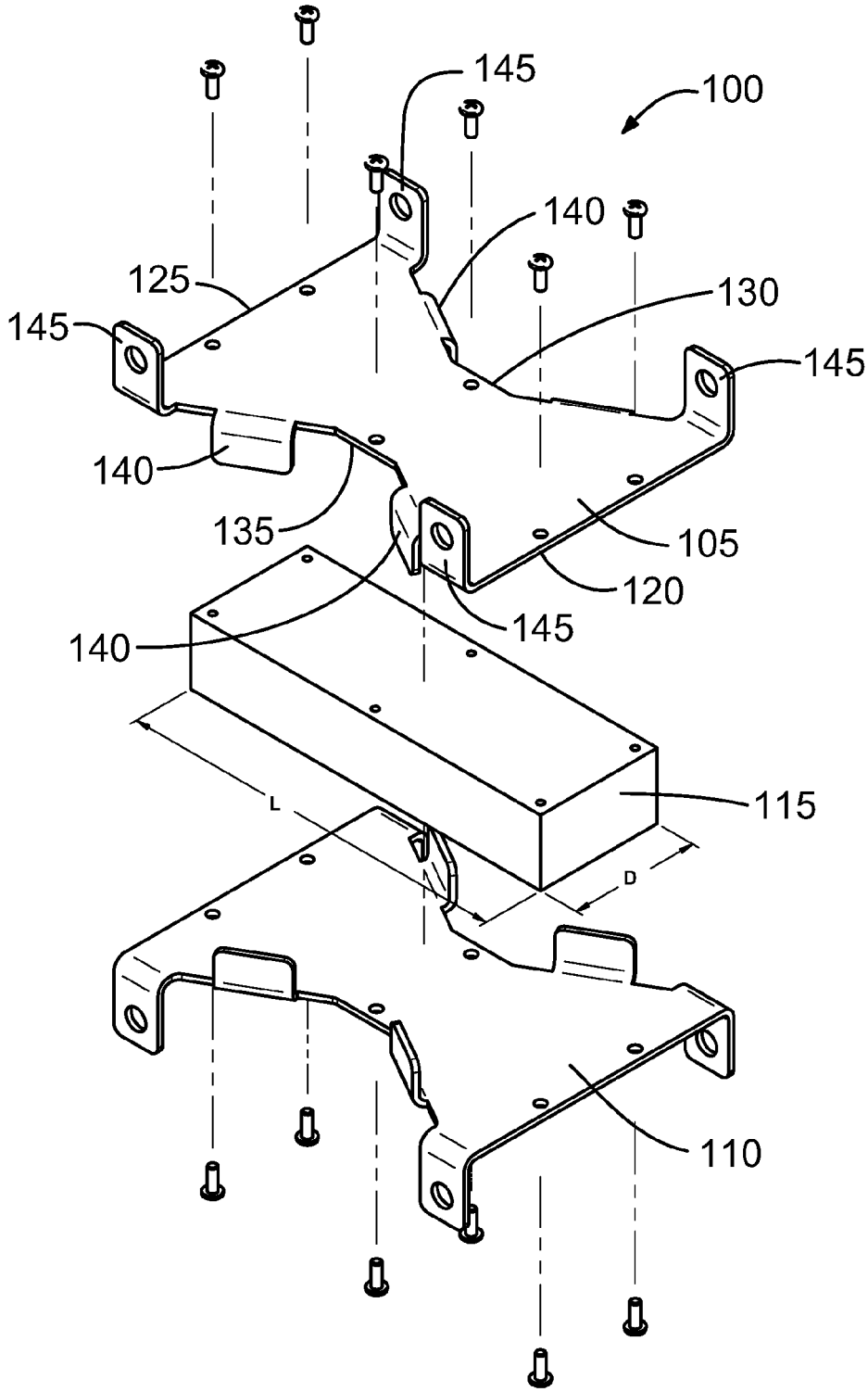
FIG. 1 is an exploded view of a universal mounting bracket in accordance with some embodiments of the present invention.

Turning now to the figures, in which like numerals refer to like elements through the several figures, FIG. 1 illustrates an exploded view of the universal mounting assembly 100 in accordance with some embodiments of the present invention. The universal mounting assembly 100 contains a top plate 105, a bottom plate 110, and a spacer 115. The top plate 105 and the bottom plate 110 are identical in one exemplary embodiment to one another and contain the same features. The bottom plate 110 is rotated 180 degrees in relation to the top plate 105 so that it forms a mirror image of the top plate 105. Because the top plate and the bottom plate 110 are identical, the discussion will only be described with reference to the top plate 105. Those skilled in the art will understand that the features described for the top plate 105 also apply to the bottom plate 110.

The top plate 105 of the universal mounting assembly 100 contains two side edges 120 and 125, which are substantially parallel to one another. The two side edges 120 and 125 are integrally joined or connected by two substantially curved edge portions 130 and 135. The substantially curved edge portions 130 and 135 are concave in shape and have a radius of curvature of in the range of approximately 6.5 cm to approximately 13 cm.

The top plate 105 also contains at least one mounting tab 140 located along a portion of each of the substantially curved edge portions 130 and 135. In one exemplary embodiment, the top plate 105 contains two mounting tabs 140 along each of the substantially curved edge portions 130 and 135 and are arranged so that they are oriented substantially perpendicular to the top plate 105. Although the exemplary embodiment describes each of the curved edge portions 130 and 135 as each having two mounting tabs 140, those skilled in the art will appreciate that curved edge portions 130 and 135 may contain any number of mounting tabs 140 without departing from the scope of the invention. For example, in an exemplary embodiment, each of the substantially curved edge portions 130 and 135 may contain a single mounting tab 140 that extends the entire length of the substantially curved edge portions 130 and 135. In another exemplary embodiment, the substantially curved edge portions 130 and 135 contain three or more mounting tabs spaced-apart along the length the substantially curved edge portions 130 and 135. Furthermore, plural mounting tabs 140 are not necessarily identical when two or more tabs are present.

The top plate 105 also contains several planar mounting brackets 145. In one exemplary embodiment, the planar mounting brackets 145 are located at the intersection of the parallel edge portions 120 and 125 and the substantially curved edge portions 130 and 135. The planar mounting brackets 145 are oriented substantially perpendicular to the top plate 105 and are used to connect the universal mounting bracket 100 to planar surfaces, as described below in more detail. Those skilled in the art will appreciate that, like the tabs 140, the planar mounting brackets 145 may vary in number, location along the edges, size, and shape, for example.

Both the top plate 105 and the bottom plate 110 are preferably made from a suitable sheet material, such as a metal or a metal alloy, including but not limited to stainless steel, aluminum, sheet metal, plated steel, titanium, and the like. Environmental conditions for outdoor use are a factor in the choice of metals and finishes. An exemplary material is stainless steel with a passivation finish for the top plate 105 and the bottom plate 110. Additionally, the top plate 105 and the bottom plate 110 may be made from non-metal materials, such as polymers, thermoplastics, ceramics, and the like. Both the top plate 105 and the bottom plate 110 may be manufactured using standard techniques. For example, both the top plate 105 and the bottom plate 110 may be stamped from a blank of the suitable sheet material. The mounting tabs 140 and the planar mounting brackets 145 may be bent using conventional means so that they are oriented approximately perpendicular to the top plate 105, and bottom plate 110, respectively. Each of the substantially curved edge portions 130 and 135 may be formed by cutting a series of linear facets in the top plate 105 and bottom plate 110 to form a substantially curved surface. Alternatively, the substantially curved edge portions 130 and 135 may be formed by cutting a continuous arc in each of the top plate 105 and bottom plate 110. The cutting operations may be accomplished by laser cutting, water jet cutting, stamping with tools or dies, for example.

The spacer 115 is used to separate and hold the top plate 105 and the bottom plate 110 into a predefined fixed position relative to one another. The spacer 115 has a length. L, which extends between the two side edge portions 120 and 125 and a width, D, which extends between the two substantially curved edge portions 130 and 135. The top plate 105 and the bottom plate 110 are rigidly affixed to the spacer 115 through the use of several fasteners 150, such as screws or bolts. Other types of fasteners that may be used to connect the top plate 105 and the bottom plate 110 to the spacer, include, but are not limited to, rivets, welds, fusion bonds, and adhesives.

The spacer 115 may be made from a solid block of material to provide dimensional stability when the universal mounting assembly 100 is stressed under a heavy load. Alternatively, for applications in which two lightweight support structures must be joined and produce light stress loads, the spacer 115 may have an annular shape rather than being formed of a solid piece of material. Using an annular shape reduces the overall weight of the universal mounting assembly 100, while still retaining the overall structural integrity. The annular shaped spacer 115 may be formed by forming a strip of sheet material into an annular form and connecting the two ends either using fasteners, adhesives, or weld joints. Alternatively, the annular-shaped spacer may be cut from a solid piece of material using a laser cutter, a plasma cutter, a high pressure water jet, or a standard milling machine. For applications, in which the overall weight needs to be minimized while still maintaining a high degree of structural integrity, the spacer 115 may be constructed of an annular ring with several inwardly projecting baffles or support structures to provide additional strength. Typically, the spacer 115 is constructed from the same materials used for constructing the top plate 105 and the bottom plate 110. For instance, the spacer 115 may be constructed from a metal or metal alloy, including but not limited to stainless steel, aluminum, sheet metal, plated steel, and titanium. The spacer 115 may also be constructed using a composite material, which may include but not limited to polymers, thermoplastics, carbon fiber composites, and ceramics.

Figure 2:
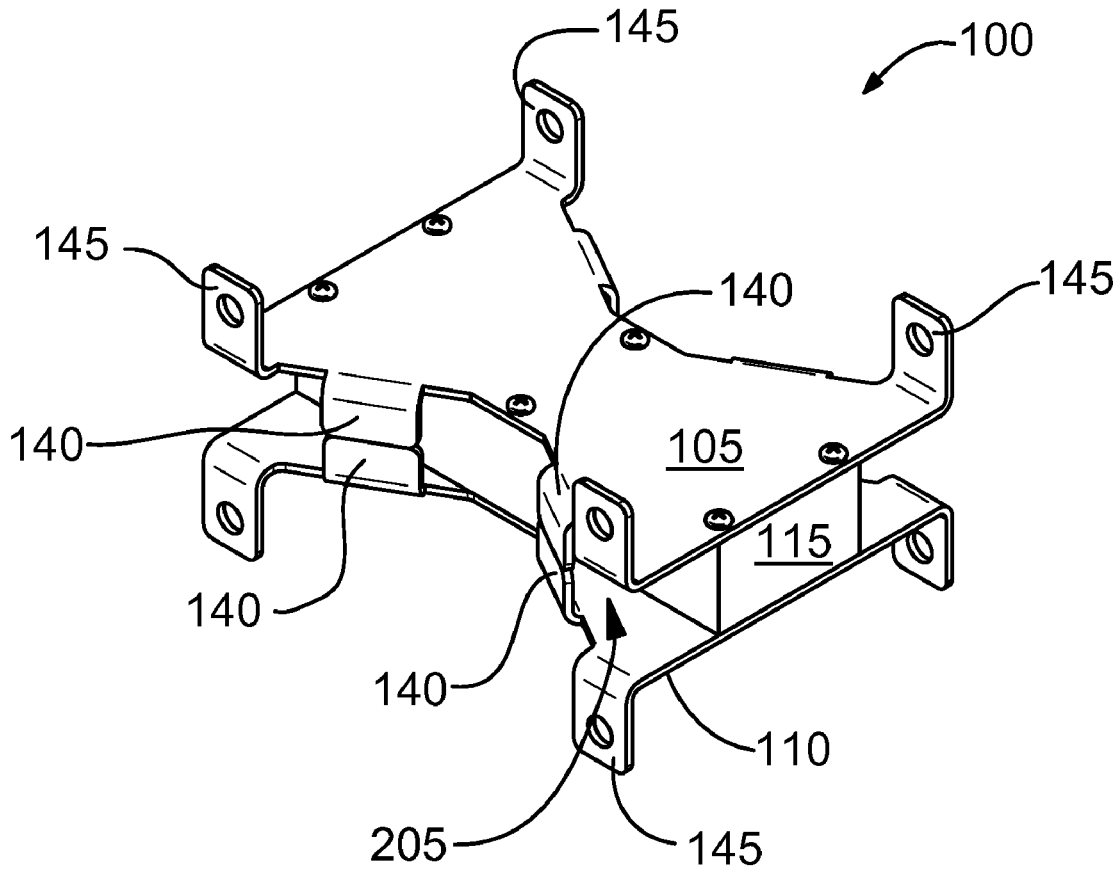
FIG. 2 is an isometric view of the universal mounting bracket in accordance with some embodiments of the present invention.

FIG. 2 illustrates a perspective view of the universal mounting bracket 100. As shown in the figure, when the top plate 105 and bottom plate 110 are connected to the spacer 115, the mounting tabs 140 from the top plate 105 and the bottom plate 110 are placed proximate to one another so that together with the spacer 115 they form a channel 205, in which a fastener, such as a band clamp, can be inserted for connecting the universal mounting assembly 100 to a cylindrical support structure. The substantially curved surfaces 130 and 135 of the top plate 105 and the bottom plate 110 forms a concave surface, which is particularly adapted for attachment to a cylindrical support structure, such as a vertical pole or mast. The mounting tabs 140 located along the length of the substantially curved surfaces 130 and 135 of the top plate 105, and the bottom plate 110, respectively, are adapted for attaching to the cylindrical support structure.

Figure 3:
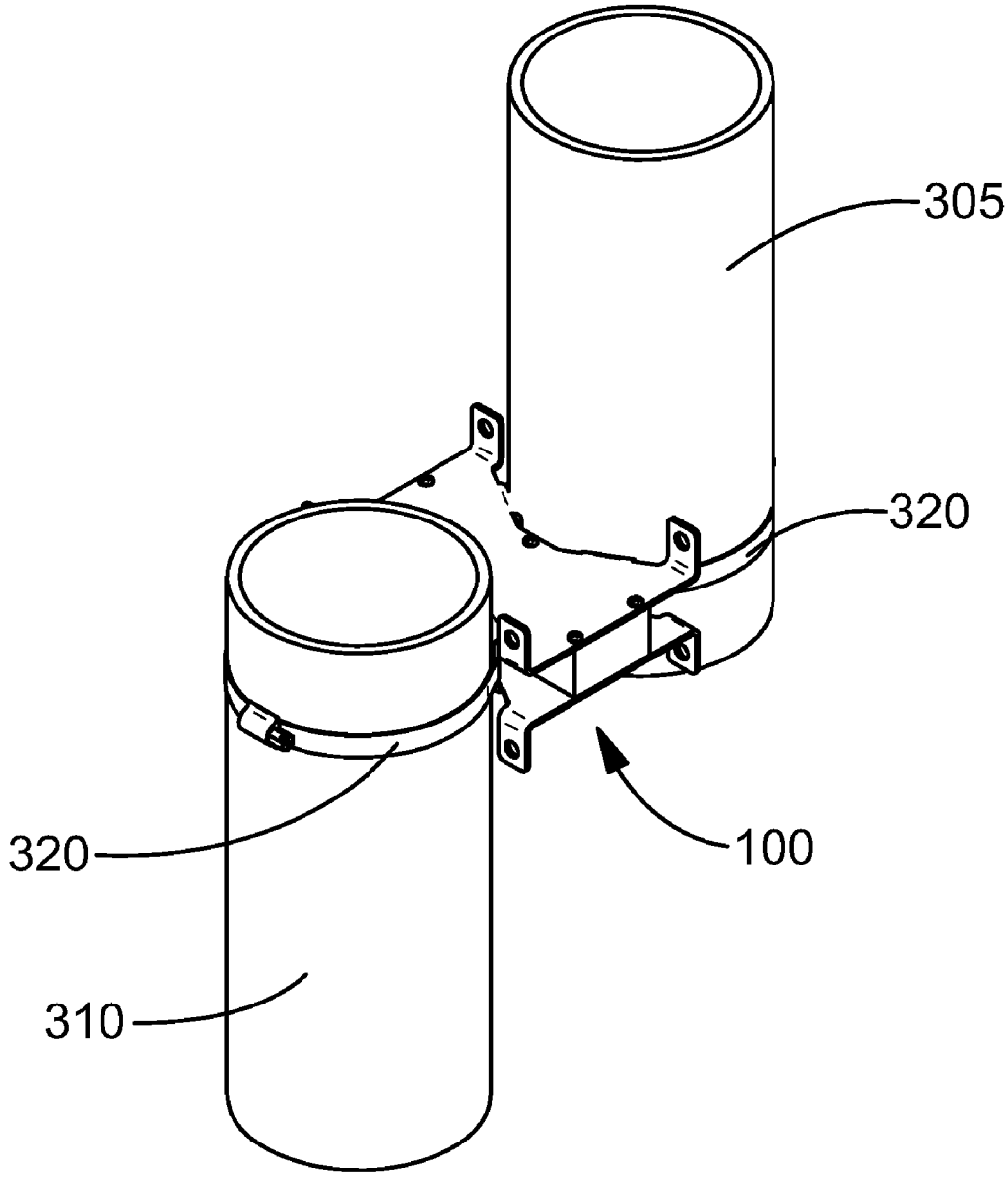
FIG. 3 is an illustration of the universal mounting bracket joining two cylindrical surfaces in accordance with some embodiments of the present invention.
Figure 4:
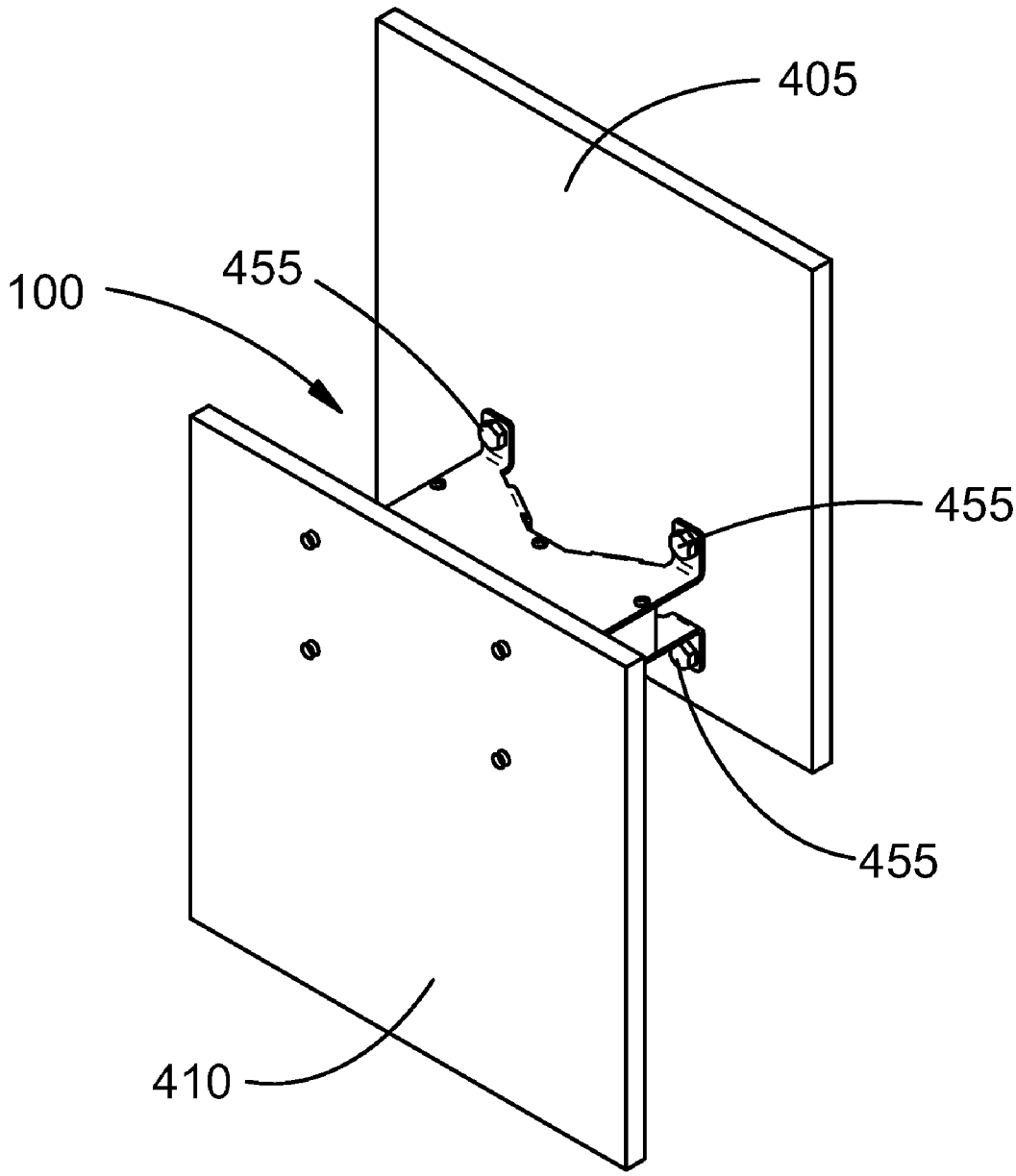
FIG. 4 is an illustration of the universal mounting bracket joining two planar surfaces in accordance with some embodiments of the present invention.
Figure 5:
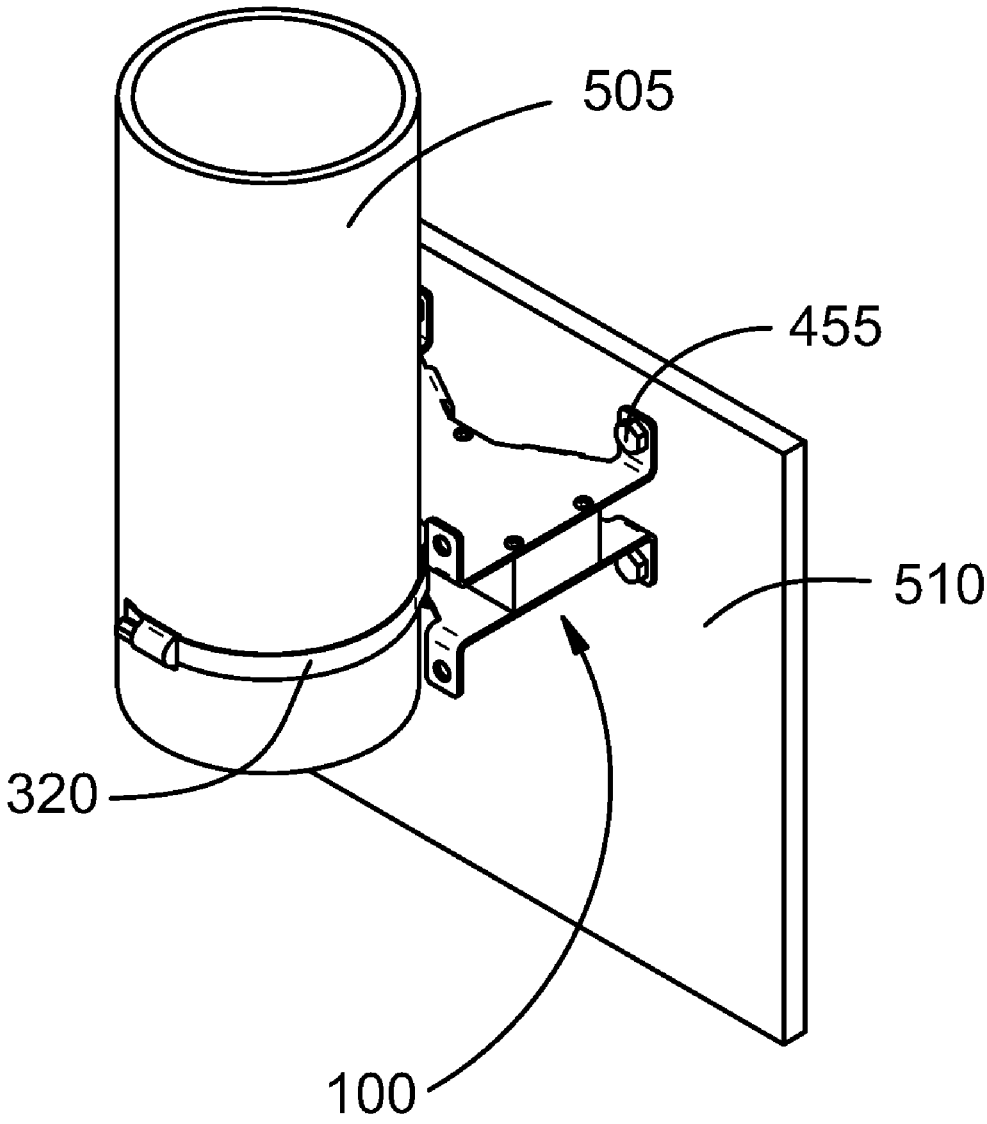
FIG. 5 is an illustration of the universal mounting bracket joining a cylindrical surface and a planar surface.

FIG. 3, FIG. 4, and FIG. 5 illustrate the universal mounting assembly 100 joining a variety of different shaped support structures to one another. The novelty and versatility of the universal mounting assembly 100 is that it eliminates the need for different shaped mounting assemblies for different support structures. Since the mounting tabs 140 and the planar mounting brackets 145 are co-located on both the top plate 105 and the bottom plate 110, the universal mounting assembly can be attached either to a curved support structure, a planar support structure, or a combination thereof. FIG. 3 provides an illustration of the universal mounting bracket 100 used to join two cylindrical support structures 305 and 310. A fastener, such a band clamp 320 is passed through the channel 205 and around each of the cylindrical support structures 305 and 310. By tightening the band clamps 320, the band clamps 320 engage the mounting tabs 140 of both the upper plate 105 and the lower plate 110 and rigidly affix the entire universal mounting bracket 100 to the cylindrical support structures 305 and 310. The substantially curved surfaces 130 and 135 are adapted to allow the universal mounting bracket to be mounted to cylindrical structures of varying diameters. In particular, the universal mounting assembly 100 may be mounted to cylindrical support structures that have diameters in the range of approximately 6.5 cm to approximately 13 cm. The ability of the universal mounting assembly 100 to be attached to cylindrical support structures with varying diameters eliminates the need for cellular providers to carry and use separate mounting brackets for different support structures, thereby reducing the overall costs associated with installation. Although the mounting tabs 140 are shown to be directly in contact with the cylindrical support structures 305 and 310, a gasket (not shown) may be inserted between planar mounting brackets 145 and the planar surfaces 405 and 41 to provide vibration dampening, electrical isolation, and the like. A gasket may be non-conducting serving primarily as an environmental seal or conducting to provide electromagnetic interference (EMI) shielding effectiveness.

FIG. 4 provides an illustration of the universal mounting assembly 100 used to join two planar support structures 405 and 410. The planar mounting brackets 145 on the top plate 105 and the bottom plate 110 are placed in contact with the planar structures 405 and 410. The universal mounting assembly 100 is then secured to the planar surfaces by passing a fastener 455 through the mounting holes 155. As the fasteners 455 are tightened, the universal mounting assembly 100 is rigidly affixed to the planar surfaces 405 and 410. The universal mounting assembly 100 may also contain gaskets (not shown) that are disposed between each of the planar mounting brackets 145 and the planar surfaces 405 and 410 to provide vibration dampening, electrical isolation, and the like.

FIG. 5 is an illustration of the universal mounting bracket 100 used to join a cylindrical support structure 505 to a planar support structure 510. The planar mounting brackets 145 from the top plate 105 and the bottom plate 110 of one side of the universal mounting assembly 100 are rigidly affixed to the planar support structure 510 using fasteners 455. The cylindrical support structure 505 is placed in contact with the mounting tabs 140 of both the upper plate 105 and the lower plate 110. The band clamp 320 is passed through the channel 205 and around the cylindrical support structure 205, which rigidly affixes the cylindrical support structure to the universal mounting bracket 100, thereby joining the cylindrical support structure 505 to a planar support structure 510.

Figure 6A:
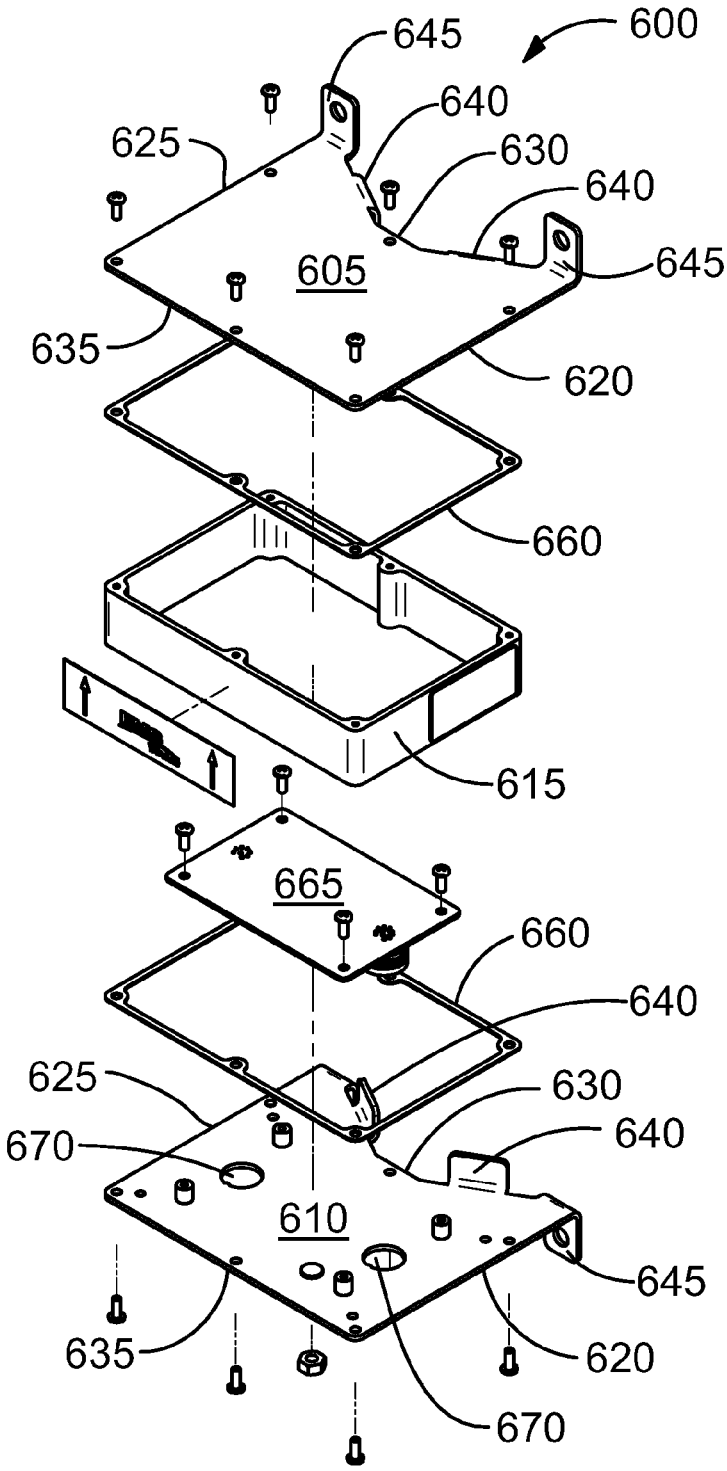
FIG. 6A is an illustration of a universal mounting bracket for attaching electronic components to either a cylindrical or planar surface in accordance with another embodiment of the present invention.
Figure 6B:
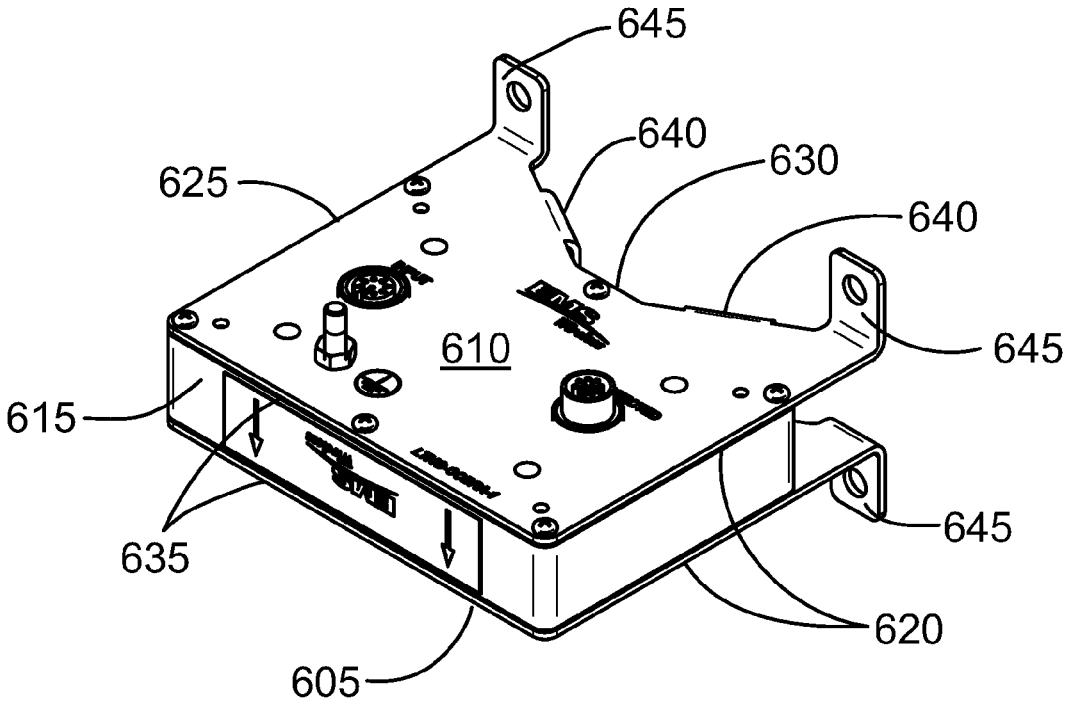
FIG. 6B is an illustration of an isometric top view of a universal mounting bracket for attaching electronic components to either a cylindrical or planar surface in accordance with another embodiment of the present invention.

FIGS. 6A and 6B provide an illustration of another embodiment of a universal mounting bracket 600 in accordance with some embodiments of the present invention. The universal mounting assembly 600 is nearly identical to the universal mounting assembly 100 shown in FIGS. 1-5, with the exception that the universal mounting assembly 600 contains only one curved edge portion and is used for mounting an electronic component 665 to a support structure.

Although almost any electronic component may be housed within the annular-shaped spacer 615, FIGS. 6A and 6B illustrates an exemplary embodiment of the invention, in which the electrical component 665 is a lightning protection circuit to protect cellular telephone antennas from power surges due to lightning strikes or other induced electrical surges that may appear on or between the conductors of a cable assembly carrying power and/or control signals to and from a device such as an antenna. Typically, cellular telephone antennas are mounted high above the surrounding structures on masts or poles or to the side of structures, which make them susceptible to lightning strikes, which may damage the circuitry associated with the antenna. Most of the cellular antennas attached to the tower masts include a passive lightning rod, which "bleeds" the energy from a lightning strike to the ground. However, some of the energy from the lightning strike can still travel through the cabling connecting the antenna to the circuitry. A nearby lightning strike can induce differential current and voltages on the conductors and potentially harm any electronics mounted on or locally connected to the tower and/or antenna system. Therefore, electrical components, known as transient suppressors, can be installed to protect the electrical circuits associated with the cellular antennas. Typically, these transient suppressors are applied after the antennas have been installed. The universal mounting bracket 600 is designed to provide a single bracket for attaching the lightning protection device, or any other electrical component 665, to any existing cellular tower structure. The lightning protection circuit is typically mounted in the universal mounting bracket 600 near the cellular antenna and is connected in series between the antenna and the antenna circuitry through an input and output port. An exemplary wired connection between the antenna and the antenna circuitry can be via a shielded multi-conductor cable between the antenna and the electronics equipment remotely located from the antenna that connects through an input and output port.

The universal mounting assembly 600 shown in FIGS. 6A and 6B includes a top plate 605, a bottom plate 610, and an annular-shaped spacer 615 disposed between the top plate 605 and the bottom plate 610. The top plate 605 and the bottom plate 610 contain a single substantially curved edge portion 630 disposed between two parallel edge portions 620 and 625. A straight edge portion 635 is disposed between the two parallel edge portions 620 and 625 and oriented opposite the substantially curved edge portion 630. The curved edge portion 630, 635 of the top plate 605 and 610, respectively, each contain at least one mounting tab 640 for mounting the universal bracket to a curved support structure 205 (FIG. 2). In one exemplary embodiment of the universal mounting assembly 600, each curved edge portion 630 contains two mounting tabs 640. The mounting tabs 640 of the top plate 605 are placed proximate to the mounting tabs 640 of the bottom plate 610 and form a channel 670 in conjunction with the annular-shaped spacer 615 for accepting a band clamp 215 (FIG. 2).

To mount the universal mounting assembly 600 to a cylindrical support structure 305 (FIG. 3), the mounting tabs 640 are placed in contact with the cylindrical support structure 305. As the band clamp 320 is tightened, the band clamp 320 engages the mounting tabs 640 on the substantially curved edge portions 630 and 635 to rigidly affix the universal mounting bracket 600 to the cylindrical support structure 305.

The top plate 605 and the bottom plate 610 also contain a pair of planar mounting tabs 645 located at the intersection of the parallel edge portions 620 and 625 with the curved edge portion 630. As shown in FIGS. 6A and 6B, the planar mounting tabs 645 are oriented approximately perpendicular to the top plate 605 and the bottom plate 610. The planar mounting tabs 645 are placed in contact with a planar support surface 4050 (FIG. 4) and the universal mounting assembly 600 can be rigidly secured to the planar support by using fasteners inserted through the mounting holes 155.

The annular-shaped spacer 615 is disposed between the top plate 605 and the bottom plate 610. In addition to providing structural integrity to the universal mounting assembly 600, the annular-shaped spacer 615 may also accommodate a lightning protection circuit 665. The lightning protection circuit 665 is typically mounted to a circuit board and may have several input and/or output ports. Depending on the configuration of the lightning protection circuit 665, the top plate 605 and or the bottom plate 610 may include one or more openings to accommodate these ports. In the universal mounting assembly 600 illustrated in FIGS. 6A and 6B, the bottom plate 610 is depicted as contains several openings 670 to allow access to the input/output ports associated with the lightning protection circuit 665.

In order to weatherproof the universal mounting bracket and protect lightning protection circuit 665, the universal mounting assembly 600 may also include several gaskets 660 that are disposed between both the top plate 605 and the annular-shaped spacer 615 and between the bottom plate 610 and the annular-shaped spacer 615. The gaskets 660 may be constructed from any known suitable material and can be electrically insulating or conducting gaskets.

Other alternative embodiments will become apparent to those skilled in the art to which an exemplary embodiment pertains without departing from its spirit and scope. Accordingly, the scope of the present invention is defined by the appended claims rather than the foregoing description.

I claim:

1. A universal mounting assembly, comprising:

a top plate;

a bottom plate, wherein the top plate and the bottom plate comprise:

a pair of parallel edge portions;

at least one substantially curved edge portion disposed between the pair of substantially parallel edge portions;

at least one mounting tab disposed along a portion of the substantially curved edge portion;

at least one planar mounting bracket; and a spacer disposed between the top plate and the bottom plate, wherein the bottom plate is oriented so as to form a mirror image of the top plate.

2. The universal mounting assembly of claim 1, wherein the at least one substantially curved edge portion is concave in shape.

3. The universal mounting assembly of claim 2, wherein the at least one mounting tab on the top plate and the at least one mounting tab on the bottom plate are proximate to one another and form a channel for receiving a fastener.

4. The universal mounting assembly of claim 3, wherein the substantially curved edge portion is placed in contact with a cylindrical support structure and allows the universal mounting assembly to be attached to the cylindrical support structure.

5. The universal mounting assembly of claim 1, wherein the planar mounting brackets allow the universal mounting assembly to be attached to a planar support structure.

6. The universal mounting assembly of claim 1, wherein the top plate and the bottom plate are made from a plate material, the plate material comprising a metal, a metal alloy, or a composite material.

7. The universal mounting assembly of claim 1, wherein the spacer comprises a solid structure.

8. The universal mounting assembly of claim 1, wherein the spacer comprises an annular structure.

9. A universal mounting assembly for connecting an electronic component to a support structure, the universal mounting assembly comprising:

a top plate;

a bottom plate;

wherein the top plate and the bottom plate comprise:

a pair of parallel edge portions;

a substantially curved edge portion disposed between the pair of substantially parallel edge portions; and a linear edge portion disposed between the pair of parallel edge portions;

at least one mounting tab located along a portion of the substantially curved edge portion for mounting to a cylindrical support structure; and a planar mounting bracket located at the intersection of the parallel edge portions and a plurality of concave curved portions for mounting to a planar support structure; and an annular spacer located between the top plate and the bottom plate, wherein the electronic component is housed within the annular spacer.

10. The universal mounting assembly of claim 9, wherein the bottom plate further comprises an input port connected to the electronic component and an output port for connected to the electronic component.

11. The universal mounting assembly of claim 9, further comprising a fastener for engaging the mounting tab of the top plate and the mounting tab of the bottom plate and securing the universal mounting assembly to the cylindrical support structure.

12. The universal mounting assembly of claim 9, further comprising a gasket disposed between the top plate and the annular spacer and the bottom plate and the annular spacer.

13. The universal mounting assembly of claim 9, wherein the top plate, the bottom plate and the annular spacer are made of a material comprising a metal, a metal alloy, or a composite material.

14. A universal mounting assembly system for connecting an antenna to an electronic component, comprising:

an antenna;

a support structure; and a universal mounting assembly, comprising:

a top plate;

a bottom plate;

wherein the top plate and the bottom plate comprise:

a pair of parallel edge portions;

a substantially curved edge portion disposed between the pair of parallel edge portions; and a linear edge portion disposed between the pair of parallel edge portions;

at least one mounting tab located along a portion of the substantially curved edge portion for mounting to a cylindrical support structure; and a planar mounting bracket located at the intersection of the parallel edge portions and a plurality of concave curved portions for mounting to a planar support structure;

an annular spacer located between the top plate and the bottom plate; and the electronic component operably connected to the antenna.

15. The antenna system of claim 14, wherein the support structure is a cylindrical support structure.

16. The antenna system of claim 15, further comprising a fastener for engaging the mounting tab of the top plate and the mounting tab of the bottom plate and securing the universal mounting assembly to the cylindrical support structure.

17. The antenna system of claim 15, further comprising fasteners for securing the planar mounting brackets to the planar support structure.

18. The antenna system of claim 14, wherein the support structure is a planar support structure.

19. The antenna system of claim 14, wherein the electronic component is a lightning protection circuit.

20. The antenna system of claim 14, further comprising a gasket disposed between the top plate and the annular spacer and the bottom plate and the annular spacer.

* * * * *